US008746458B2

(12) United States Patent
Zhang et al.

(10) Patent No.: US 8,746,458 B2
(45) Date of Patent: Jun. 10, 2014

(54) AXIAL SORTING METHOD AND DEVICE WITH PERMANENT-MAGNET DRUM ECCENTRIC INNER SURFACE

(75) Inventors: Xiaonian Zhang, Hubei (CN); Jiazhen Li, Hubei (CN)

(73) Assignee: Hubei Shengrong Environmental Protection Energy-Saving Science and Technology Ltd., Hubei (CN)

( * ) Notice: Subject to any disclaimer, the term of this patent is extended or adjusted under 35 U.S.C. 154(b) by 146 days.

(21) Appl. No.: 13/262,221

(22) PCT Filed: Mar. 30, 2010

(86) PCT No.: PCT/CN2010/000407

§ 371 (c)(1),
(2), (4) Date: Sep. 29, 2011

(87) PCT Pub. No.: WO2010/111893

PCT Pub. Date: Oct. 7, 2010

(65) Prior Publication Data

US 2012/0024762 A1 Feb. 2, 2012

(30) Foreign Application Priority Data

Mar. 30, 2009 (CN) ..... 2009 1 0061341

(51) Int. Cl.
*B03C 1/00* (2006.01)

(52) U.S. Cl.
USPC ..... 209/224; 209/223.1; 209/225

(58) Field of Classification Search
USPC ..... 209/219, 221, 223.1, 224, 225, 226, 209/227
See application file for complete search history.

(56) References Cited

U.S. PATENT DOCUMENTS 3,021,951 A * 2/1962 Holt ..... 209/221
4,046,679 A * 9/1977 Schloemann ..... 209/212

(Continued)

FOREIGN PATENT DOCUMENTS

CN 2928248 Y 1/2007
JP 3068463 A 1/1991

OTHER PUBLICATIONS

International Preliminary Report on Patentability (Chapter 1) for PCT Application No. PCT/CN2010/000407, of Oct. 4, 2011.

(Continued)

*Primary Examiner* — Ernesto Suarez
(74) *Attorney, Agent, or Firm* — Kilpatrick Townsend & Stockton LLP

(57) ABSTRACT

The present invention discloses a method for axial separation by an eccentric inner surface of a permanent magnetic drum, comprising: adsorbing materials to be selected that flow through the inner surface field strength and the gradient area of a rotating eccentric drum (2) by using the energy on the inner surface of a rotating permanent magnetic drum (1), wherein materials with lower specific susceptibility pass through a selected material channel (14) consisted of the eccentric drum (2) and the outer surface of the arched drum of a field strength gradient regulating mechanism (5), and flow out of a low magnetic material outlet (9); materials with higher specific susceptibility are absorbed on the rotating eccentric drum (2), and in an area with higher eccentricity, materials with higher specific susceptibility are stripped off, fall into a high magnetic material groove (7), flow to a high magnetic material outlet (8), and then are collected. There also provides a device for axial separation by an eccentric inner surface of a permanent magnetic drum.

5 Claims, 2 Drawing Sheets

(56) References Cited

U.S. PATENT DOCUMENTS

| | | | | | |
|---|---|---|---|---|---|
| 4,318,804 | A | * | 3/1982 | Nakajima | 209/221 |
| 4,693,812 | A | * | 9/1987 | Bond et al. | 209/224 |
| 5,752,435 | A | * | 5/1998 | Wai | 99/567 |
| 5,975,310 | A | * | 11/1999 | Darling et al. | 209/636 |
| 2012/0125821 | A1 | * | 5/2012 | Zhang et al. | 209/214 |

OTHER PUBLICATIONS

Translation of Chinese Patent Publication No. 2928248, published Aug. 1, 2007. (Abstract only).

Translation of Japanese Patent Publication No. 3068463, published Mar. 25, 1991. (Abstract only).

* cited by examiner

AXIAL SORTING METHOD AND DEVICE WITH PERMANENT-MAGNET DRUM ECCENTRIC INNER SURFACE

FIELD OF THE INVENTION

The present invention relates to the technical field of environment protection devices, and in particular, to a method and a device for axial separation by an eccentric inner surface of a permanent magnetic drum.

BACKGROUND OF THE INVENTION

For a conventional permanent magnetic separator or separating system, permanent magnetic materials are generally inserted in the outer surface of a drum or roller, and substances with different specific susceptibilities are separated by using the energy generated on the outer surface thereof. Moreover, there are two feeding modes, i.e., feeding on the outer surface of a permanent magnetic drum and feeding under the outer surface of a permanent magnetic drum. In the mode of feeding on the outer surface of a permanent magnetic drum, materials to be selected can contact directly with the magnetic surface, the residence time of the materials to be selected on the magnetic outer surface is short, the adsorptive capacity is large, but the separation effect will be effected, thus in such a mode, the yield may be increased, but the separation effect will be poor; in the mode of feeding under the outer surface of a permanent magnetic drum, there is a certain gap between the materials to be selected and the magnetic outer surface, the separation effect is good, but the yield is low, and greater object product will be run off.

In the traditional separation of materials to be selected, the stripping off of a high magnetic material is realized by a scraper or brush roller, or a magnetic material is partially inserted in the permanent magnetic drum or roller, and when the drum or roller rotates to an area without magnetic materials, the high magnetic material is flushed with water and falls into a high magnetic material groove or silo; for a conventional separator or separating system, the included angle between the whole system and the plane is nonadjustable, and its capacity for treating the materials to be selected is poor and the residence time of the materials to be selected on the permanent magnetic drum or roller is short; the surface field strength and gradient of the conventional permanent magnetic separator or separating system is a fixed value, thus the range of materials to be selected by a conventional permanent magnetic separator or separating system and the capacity of the conventional permanent magnetic separator or separating system is very limited.

SUMMARY OF THE INVENTION

It is an object of the present invention to develop a system for physically separating metals and nonmetals or various substances with different specific susceptibilities by using the energy on the inner surface of a permanent magnetic drum, the principle of which lies in a method and a device for axial separation by an eccentric inner surface of a permanent magnetic drum, which can accomplish an effective separation by using the difference between the specific susceptibilities of substances.

The method for axial separation by an eccentric inner surface of a permanent magnetic drum according to the present invention comprises: adsorbing materials to be selected that axially flow through the inner surface field strength of the rotating eccentric drum 2 and the gradient area, by using the energy on the inner surface of a rotating permanent magnetic drum 1. Under the action of gravity, materials with lower specific susceptibility axially pass through a selected material channel 14 consisted of the eccentric drum 2 and the outer surface of the arched drum of a field strength gradient regulating mechanism 5, and flow out of a low magnetic material outlet 9; under the action of the inner surface field strength and the gradient of the permanent magnetic drum 1, materials with higher specific susceptibility are adsorbed on the rotating eccentric drum 2, because the permanent magnetic drum 1 and the eccentric drum 2 are relatively eccentric, the field strength and the gradient decrease down to 0 gradually, and in an area with higher eccentricity, materials with higher specific susceptibility are stripped off and fall into a high magnetic material groove 7, flow to a high magnetic material outlet 8, and then are collected, so that various materials with different specific susceptibilities can be separated.

The device for axial separation by an eccentric inner surface of a permanent magnetic drum according to the present invention comprises: a bracket 0, on which a permanent magnetic drum assembly is mounted, and an eccentric drum 2 of the eccentric drum assembly is mounted in a permanent magnetic drum 1 of the permanent magnetic drum assembly, because the permanent magnetic drum 1 and the eccentric drum 2 are relatively eccentric, the field strength and the gradient decrease down to 0 gradually, and in an area with higher eccentricity, materials with higher specific susceptibility are stripped off and fall into a high magnetic material groove 7.

The permanent magnetic drum assembly comprises: a permanent magnetic drum 1, a permanent magnetic drum support 10 and a permanent magnetic drum rotation mechanism 13. The permanent magnetic drum 1 is connected with the roller wheels of the permanent magnetic drum support 10 of which the two ends are mounted on the bracket 0; the permanent magnetic drum rotation mechanism 13 is mounted on the bracket 0, a connection wheel in the permanent magnetic drum rotation mechanism 13 is engaged with a toothed ring on the permanent magnetic drum, or a friction wheel in the permanent magnetic drum rotation mechanism 13 is in friction combination with the outer surface of the permanent magnetic drum.

The eccentric drum assembly comprises: an eccentric drum 2, an eccentric drum support 11, an eccentric drum rotation regulating mechanism 3, a cleaning roller 12, a high magnetic material groove 7 and a field strength gradient regulating mechanism 5; the eccentric drum 2 is connected with the roller wheels of the eccentric drum support 11 of which the two ends are mounted on the bracket 0; the cleaning roller 12, high magnetic material groove 7 and the field strength gradient regulating mechanism 5 are mounted inside the eccentric drum 2; the support members on the two ends of the cleaning roller 12, the high magnetic material groove 7 and the field strength gradient regulating mechanism 5 are connected with the bracket 0, and the support member of the field strength gradient regulating mechanism 5 is regulable; the selected material inlet silo 6 is connected with the bracket 0; the eccentric drum rotation regulating mechanism 3 is mounted on the bracket 0, and a toothed wheel in the eccentric drum rotation regulating mechanism 3 is engaged with a toothed ring on the eccentric drum 2, or a friction wheel in the eccentric drum rotation regulating mechanism 3 is in friction combination with the outer surface of the eccentric drum 2.

An inclination angle θ regulating mechanism 4 is mounted on the bracket 0, and the inclination angle θ regulating mechanism 4 makes the included angle θ between the plane and the whole device or the combination of the permanent magnetic drum 1 and the eccentric drum 2 regulable, with a range of −10° to 90°. The inclination angle θ regulating mechanism 4 may be a screw-thread elevating mechanism or a mechanism with other forms.

The field strength gradient regulating mechanism 5 comprises: an arched drum ABC and a support member 51 on the two ends of the arched drum, wherein the arched drum is consisted of a magnetic conductive material, and the thickness of the magnetic conductive material is greater than 0.5 mm and smaller than the diameter of the eccentric drum 2.

The high magnetic material groove 7 is connected with the high magnetic material outlet 8, and the low magnetic material outlet 9 is suspended on the bracket 0.

A selected material channel 14 is formed by the inner surface of the eccentric drum 2 and the outer surface of the arched drum ABC of the field strength gradient regulating mechanism 5. The eccentric drum 2 is an integral cylinder.

By using the energy on the inner surface of the permanent magnetic drum, materials to be selected may directly flow into and flow out from the inner surface of the eccentric drum 2. The gap between the materials to be selected and the surface of the permanent magnetic drum can be precisely regulated according to the specific susceptibility of the materials to be selected. The contact time of the materials to be selected and the eccentric drum 2, the field strength and the gradient are increased, and the separation effect will be good. Because the materials to be selected flow in and flow out axially on the inner surface of the eccentric drum 2, as orthogonal to the radial magnetic field gradient of the permanent magnetic drum, the materials to be selected contact with the field strength and the gradient area for N times, thus miss selection may be avoided, yield and recovery rate may be increased, and the separation effect may be improved.

By changing the eccentric distance via rotating the eccentric drum 2, high magnetic materials in the materials to be selected are stripped off automatically and fall into the high magnetic material groove 7 when the field strength and the gradient decrease down to zero area, wherein no water flush is needed and there is no friction loss of scrapers or hairbrush, thus a large amount of water resources are saved.

The inclination angle θ regulating mechanism 4 makes the included angle between the whole device and the plane or the included angle between the plane and the whole device or the combination of the permanent magnetic drum 1 and the eccentric drum 2 variable and adjustable. The θ inclination angle may be adjusted according to the specific susceptibility of the materials to be selected, thereby the treating capacity and the residence time of the materials to be selected on the inner surface of the eccentric drum 2 may be increased or decreased, thus the separation quality may be controlled.

The field strength gradient regulating mechanism adjusts the distance between the mechanism and the inner surface of the eccentric drum 2, and the field strength and the gradient applied to the surface of the materials to be selected may be changed, thus the device may adjust the field strength and the gradient applicable for the materials to be separated. Therefore, the object of precisely separating the materials to be selected may be attained, the separation range and separation precision of the materials to be selected may be increased greatly, and the application range of the present device may be increased.

The advantages of the method and the device for axial separation by an eccentric inner surface of a permanent magnetic drum according to the present invention lie in that: as compared with the current conventional permanent magnetic separation, the yield and recovery rate of the object product may be increased greatly (especially for the separation of some substances with lower specific susceptibility); the separation range of the materials to be selected may be enlarged, the content of valuable substances in the tailings and the offscum and the separation run off of the valuable substance may be reduced, thus energy conservation and discharge reduction may be attained in deed; because the materials to be selected directly flow through the inner surface of the eccentric drum, the gap with the magnetic surface is small, and the magnetic energy will be fully utilized; in the present device, the relative distance between the materials to be selected and the strong magnetism-high gradient area is changed via the eccentric between the inner surface of the permanent magnetic drum and the eccentric drum, and the relative distance is adjustable, thus the separating and stripping off of the materials to be selected are simple; the separation range of the materials to be selected is large, and various substances such as metals, nonmetals and salts with high and low specific susceptibilities can be separated; because the magnetic field and gradient on the inner surface of the permanent magnetic drum of the current device are radially distributed and the materials to be selected flow axially, no miss selection occurs, the yield is high, and the separation effect is good; the overall inclination angle θ of the current device is regulable, thus the throughput and the residence time of the materials to be selected can be adjusted and varied; the separation effect can be changed by regulating the rotating speed of the eccentric drum; by adjusting the field strength gradient regulating mechanism according to the requirements on the specific susceptibility of the materials to be selected, the field strength and the gradient may be changed to meet the requirements of the materials to be selected.

DETAILED DESCRIPTION OF THE EMBODIMENTS

Embodiment 1

Figure 1:
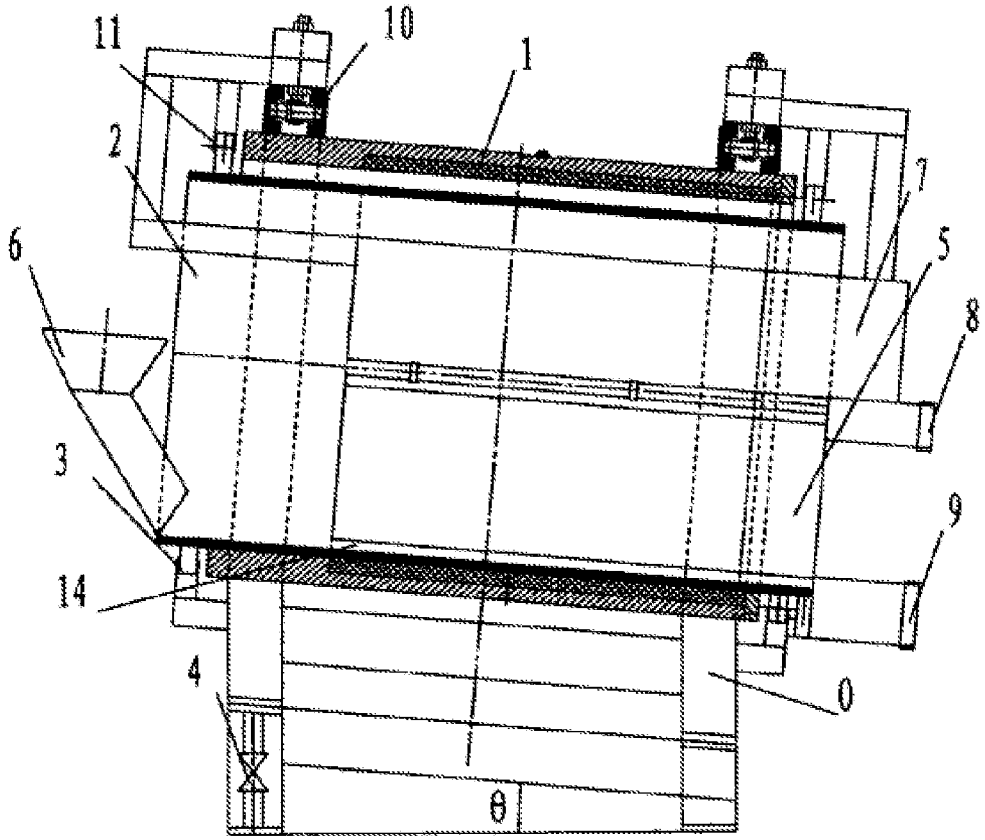
FIG. 1 is a structural representation of the device for axial separation by an eccentric inner surface of a permanent magnetic drum according to the present invention.

A method for axial separation by an eccentric inner surface of a permanent magnetic drum, which comprises: choosing the offscum discharged after electrolyzing manganese carbonate to obtain manganese metal, as the materials to be selected. The average content of manganese in the manganese carbonate offscum is 6.47%, and the average granularity is −40 mesh, which occupies about 90%. The specific susceptibility of manganese carbonate is about 100 to $600\times10^{-6}$ $cm^3/g$, and the field strength and the gradient is preferably adjusted to a value that can adsorb materials with such a specific susceptibility. The offscum is mixed with water to form a flowable paste, the flowable paste is fed from the selected material inlet 6, flows through the inner surface of the rotating eccentric drum 2 and enters the selected material channel 14; and under the action of the field strength and the gradient generated by the permanent magnetic drum 1 and the field strength gradient regulating mechanism 5, the manganese carbonate in the materials to be selected is adsorbed on the rotating eccentric drum 2, when the eccentric drum 2 rotates (both clockwise and anti-clockwise rotation can be employed) to the upper end of the permanent magnetic drum 1, the field strength and the gradient decrease down to 0 gradually; and under the action of gravity, the manganese carbonate in the materials to be selected automatically falls into the high magnetic material groove 7, and then it flows out via the high magnetic material outlet 8; the cleaning roller 12 performs rotational cleaning on the inner surface of the eccentric drum 2, which guarantees a clean and convenient adsorption of the next materials to be selected. The residual low magnetic materials with lower specific susceptibility directly flow to the low magnetic material outlet 9 via the selected material channel 14, where they are discharged. The content of the manganese carbonate-grade manganese collected by the method and the separation device according to this embodiment is as high as 27%, which is 10 percentage points higher than the content 17% of mine-grade manganese, and the average content of manganese in the secondary offscum is less than 1%.

Embodiment 2

Figure 2:
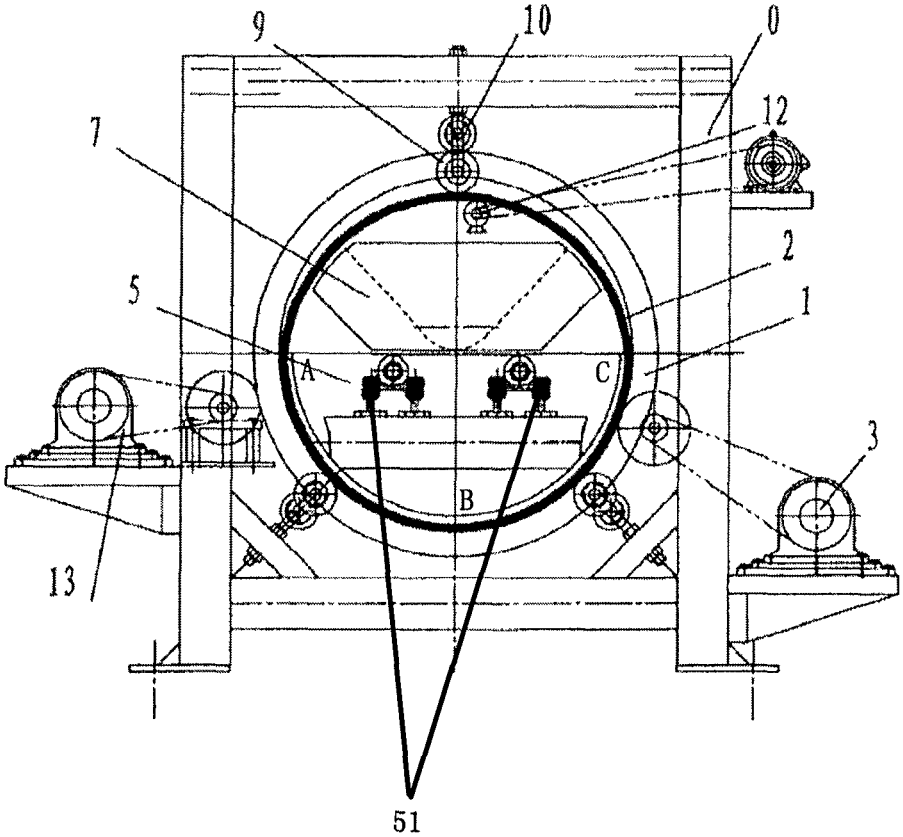
FIG. 2 is a lateral structural representation of the device for axial separation by an eccentric inner surface of a permanent magnetic drum according to the present invention.

As shown in FIG. 1 and FIG. 2, a device for axial separation by an eccentric inner surface of a permanent magnetic drum comprises: a bracket 0, on which a permanent magnetic drum assembly is mounted, wherein an eccentric drum 2 of a eccentric drum assembly is mounted in a permanent magnetic drum 1 of the permanent magnetic drum assembly; because the permanent magnetic drum 1 and the eccentric drum 2 are relatively eccentric, the field strength and the gradient decrease down to 0 gradually, and in an area with higher eccentricity, materials with higher specific susceptibility are stripped off and fall into a high magnetic material groove 7.

The permanent magnetic drum assembly comprises: a permanent magnetic drum 1, a permanent magnetic drum support 10 and a permanent magnetic drum rotation mechanism 13. The permanent magnetic drum 1 is connected with the roller wheels of the permanent magnetic drum support 10 of which the two ends are mounted on the bracket 0; the permanent magnetic drum rotation mechanism 13 is mounted on the bracket 0; a connection wheel in the permanent magnetic drum rotation mechanism 13 is engaged with a toothed ring on the permanent magnetic drum, or a friction wheel in the permanent magnetic drum rotation mechanism 13 is in friction combination with the outer surface of the permanent magnetic drum.

The eccentric drum assembly comprises: an eccentric drum 2, an eccentric drum support 11, an eccentric drum rotation regulating mechanism 3, a cleaning roller 12, a high magnetic material groove 7 and a field strength gradient regulating mechanism 5; the eccentric drum 2 is connected with the roller wheels of the eccentric drum support 11 of which the two ends are mounted on the bracket 0; the cleaning roller 12, high magnetic material groove 7 and the field strength gradient regulating mechanism 5 are mounted inside the eccentric drum 2; the support members on the two ends of the cleaning roller 12, the high magnetic material groove 7 and the field strength gradient regulating mechanism 5 are connected with the bracket 0, and the support member of the field strength gradient regulating mechanism 5 is regulable; the selected material inlet silo 6 is connected with the bracket 0, and the eccentric drum rotation regulating mechanism 3 is mounted on the bracket 0; a toothed wheel in the eccentric drum rotation regulating mechanism 3 is engaged with a toothed ring on the eccentric drum, or a friction wheel in the eccentric drum rotation regulating mechanism 3 is in friction combination with the outer surface of the eccentric drum.

An inclination angle θ regulating mechanism 4 is mounted on the bracket 0, and the inclination angle θ regulating mechanism 4 makes the included angle θ between the plane and the whole device or the combination of the permanent magnetic drum 1 and the eccentric drum 2 regulable, with a range of −10° to 90°. The inclination angle θ regulating mechanism 4 may be a screw-thread elevating mechanism or a mechanism with other forms.

The field strength gradient regulating mechanism 5 comprises: an arched drum and a support member on the two ends of the arched drum, wherein the arched drum is consisted of a magnetic conductive material, and the thickness of the magnetic conductive material is greater than 0.5 mm and smaller than the diameter of the eccentric drum 2.

The high magnetic material groove 7 is connected with the high magnetic material outlet 8, and the low magnetic material outlet 9 is suspended on the bracket 0.

A material channel 14 is formed by the inner surface of the eccentric drum 2 and the outer surface of the arched drum of the field strength gradient regulating mechanism 5. The eccentric drum 2 is an integral cylinder.

The invention claimed is:

1. A device configured for axial separation of materials by an eccentric inner surface of a permanent magnetic drum, the device comprising:

a permanent magnetic drum assembly comprising the permanent magnetic drum, a bracket, wherein the permanent magnetic drum assembly is mounted on the bracket, and an eccentric drum assembly mounted in the permanent magnetic drum, wherein the eccentric drum assembly comprises an eccentric drum, an eccentric drum support, an eccentric drum rotation regulating mechanism, a cleaning roller, a high magnetic material groove and a field strength gradient regulating mechanism; wherein two ends of the eccentric drum are connected with the eccentric drum support that is mounted on the bracket; the cleaning roller, the high magnetic material groove and the field strength gradient regulating mechanism are mounted inside the eccentric drum; a mutual support member of the cleaning roller, the high magnetic material groove and the field strength gradient regulating mechanism is connected with the bracket, and a support member of the field strength gradient regulating mechanism is regulable; a selected material inlet silo is connected with the bracket, the eccentric drum rotation regulating mechanism is mounted on the bracket, a toothed wheel in the eccentric drum rotation regulating mechanism is engaged with a toothed ring on the eccentric drum, or a friction wheel in the eccentric drum rotation regulating mechanism is in friction combination with the outer surface of the eccentric drum, wherein the field strength gradient regulating mechanism comprises an arched drum containing a magnetic conductive material, wherein the thickness of the magnetic conductive material is larger than 0.5 mm and smaller than the diameter of the eccentric drum, and wherein the device is configured for regulating the field strength and the gradient of a magnetic field being applied to materials that are being separated in the device by adjusting the distance between the field strength gradient regulating mechanism and the eccentric drum.

2. The device for axial separation by an eccentric inner surface of a permanent magnetic drum according to claim 1, wherein the permanent magnetic drum assembly comprises:

the permanent magnetic drum, a permanent magnetic drum support and a permanent magnetic drum rotation mechanism;

wherein the permanent magnetic drum is connected with roller wheels of the permanent magnetic drum support of which two ends are mounted on the bracket, the permanent magnetic drum rotation mechanism is mounted on the bracket, a toothed wheel in the permanent magnetic drum rotation mechanism is engaged with a toothed ring on the permanent magnetic drum, or a friction wheel in the permanent magnetic drum rotation mechanism is in friction combination with the outer surface of the permanent magnetic drum.

3. The device for axial separation by an eccentric inner surface of a permanent magnetic drum according to claim 1, wherein an inclination angle θ regulating mechanism is mounted on the bracket, and the inclination angle θ regulating mechanism makes an included angle θ between the whole device or the combination of the permanent magnetic drum and the eccentric drum and a plane regulable within a range of −10° to 90°.

4. The device for axial separation by an eccentric inner surface of a permanent magnetic drum according to claim 1, wherein, the eccentric drum is an integral cylinder.

5. The device for axial separation by an eccentric inner surface of a permanent magnetic drum according to claim 1, wherein a selected material channel is formed by the inner surface of the eccentric drum and the outer surface of the arched drum of the field strength gradient regulating mechanism.

* * * * *

UNITED STATES PATENT AND TRADEMARK OFFICE

CERTIFICATE OF CORRECTION

PATENT NO. : 8,746,458 B2
APPLICATION NO. : 13/262221
DATED : June 10, 2014
INVENTOR(S) : Xiaonian Zhang and Jiazhen Li It is certified that error appears in the above-identified patent and that said Letters Patent is hereby corrected as shown below:

On the Title Page, in the left-hand column, Item (30) titled FOREIGN APPLICATION PRIORITY DATA, the application number for the Chinese patent application listed should be:

-- 200910061341.9 --

Signed and Sealed this
Nineteenth Day of August, 2014

Michelle K. Lee

Michelle K. Lee
*Deputy Director of the United States Patent and Trademark Office*